US008959929B2

(12) United States Patent
Nun

(10) Patent No.: US 8,959,929 B2
(45) Date of Patent: Feb. 24, 2015

(54) MINIATURIZED GAS REFRIGERATION DEVICE WITH TWO OR MORE THERMAL REGENERATOR SECTIONS

(75) Inventor: Uri Bin Nun, Chelmsford, MA (US)

(73) Assignee: FLIR Systems Inc., Wilsonville, OR (US)

( * ) Notice: Subject to any disclaimer, the term of this patent is extended or adjusted under 35 U.S.C. 154(b) by 737 days.

(21) Appl. No.: 11/433,376

(22) Filed: May 12, 2006

(65) Prior Publication Data

US 2007/0261418 A1 Nov. 15, 2007

(51) Int. Cl.
*F25B 9/00* (2006.01)
*F25B 9/14* (2006.01)

(52) U.S. Cl.
CPC ..... *F25B 9/14* (2013.01); *F25B 2309/003* (2013.01)
USPC ..... 62/6

(58) Field of Classification Search
CPC ..... F25B 9/14; F25B 2309/003; F28F 13/003
USPC ..... 62/6; 60/526
See application file for complete search history.

(56) References Cited

U.S. PATENT DOCUMENTS

| | | | | |
|---|---|---|---|---|
| 2,906,101 | A * | 9/1959 | Gifford et al. | 62/6 |
| 3,678,992 | A * | 7/1972 | Daniels | 165/10 |
| 3,742,719 | A | 7/1973 | Lagodmos | |
| 3,969,907 | A * | 7/1976 | Doody | 62/6 |
| 4,024,727 | A | 5/1977 | Berry et al. | |
| 4,078,389 | A * | 3/1978 | Bamberg | 62/6 |
| 4,231,418 | A | 11/1980 | Lagodmos | |
| 4,375,749 | A | 3/1983 | Ishizaki | |
| 4,397,156 | A * | 8/1983 | Heisig et al. | 62/6 |
| 4,475,346 | A | 10/1984 | Young et al. | |
| 4,501,120 | A * | 2/1985 | Holland | 62/6 |
| 4,505,119 | A | 3/1985 | Pundak | |
| 4,514,987 | A | 5/1985 | Pundak et al. | |
| 4,550,571 | A | 11/1985 | Bertsch | |
| 4,574,591 | A | 3/1986 | Bertsch | |
| 4,588,026 | A | 5/1986 | Hapgood | |
| 4,711,650 | A | 12/1987 | Faria et al. | |
| 4,846,861 | A | 7/1989 | Berry et al. | |
| 4,858,442 | A | 8/1989 | Stetson | |
| 4,901,787 | A * | 2/1990 | Zornes | 165/4 |
| 4,967,558 | A | 11/1990 | Emigh et al. | |
| 5,076,058 | A | 12/1991 | Emigh et al. | |
| 5,197,295 | A | 3/1993 | Pundak | |
| 5,596,875 | A | 1/1997 | Berry et al. | |
| 5,638,684 | A | 6/1997 | Siegel et al. | |
| 5,647,217 | A | 7/1997 | Penswick et al. | |

(Continued)

FOREIGN PATENT DOCUMENTS

| | | |
|---|---|---|
| EP | 0 778 452 | 12/1996 |
| FR | 2 733 306 | 4/1995 |
| FR | 2 741 940 | 12/1995 |

*Primary Examiner* — John F Pettitt
(74) *Attorney, Agent, or Firm* — Haynes & Boone LLP

(57) ABSTRACT

The size of a miniature cryocooler (100) operating on the Stirling refrigeration cycle is further reduced by shortening a first thermal regenerator module (R) disposed on a cold side of a thermal barrier (T) and providing a second thermal regenerator module ($R_1$) disposed on a warm side of the thermal barrier (T). A thermally insulated fluid flow passage (172) is disposed to interconnect the first and second regenerator modules to thermally insulate the fluid passage (172). In combination, the first and second regenerator modules provide 100% thermal regenerator effectiveness in the device.

6 Claims, 7 Drawing Sheets

(56) References Cited

U.S. PATENT DOCUMENTS

| | | | |
|---|---|---|---|
| 5,735,128 | A | 4/1998 | Zhang et al. |
| 5,775,109 | A | 7/1998 | Eacobacci, Jr. et al. |
| 5,822,994 | A | 10/1998 | Belk et al. |
| 5,895,033 | A | 4/1999 | Ross et al. |
| 6,050,092 | A | 4/2000 | Genstler et al. |
| 6,065,295 | A | 5/2000 | Hafner et al. |
| 6,070,414 | A | 6/2000 | Ross et al. |
| 6,094,912 | A | 8/2000 | Williford |
| 6,144,031 | A | 11/2000 | Herring et al. |
| 6,167,707 | B1 | 1/2001 | Price et al. |
| 6,256,997 | B1 | 7/2001 | Longsworth |
| 6,327,862 | B1 | 12/2001 | Hanes |
| 6,397,605 | B1 | 6/2002 | Pundak |
| 6,532,748 | B1 | 3/2003 | Yuan et al. |
| 6,595,006 | B2 | 7/2003 | Thiesen et al. |
| 6,595,007 | B2 | 7/2003 | Amano |
| 6,701,721 | B1 | 3/2004 | Berchowitz |
| 6,778,349 | B2 | 8/2004 | Ricotti et al. |
| 6,779,349 | B2 | 8/2004 | Yoshimura |
| 6,809,486 | B2 | 10/2004 | Qiu et al. |
| 6,886,348 | B2 | 5/2005 | Ogura |
| 6,915,642 | B2 | 7/2005 | Ravex |

* cited by examiner

MINIATURIZED GAS REFRIGERATION DEVICE WITH TWO OR MORE THERMAL REGENERATOR SECTIONS

CROSS REFERENCE TO RELATED APPLICATIONS

The present invention is related to U.S. patent application Ser. No. 11/432,957, entitled CABLE DRIVE MECHANISM FOR SELF-TUNING REFRIGERATION GAS EXPANDER, by Uri Bin-Nun filed even dated herewith; now U.S. Pat. No. 7,555,908;

Ser. No. 11/433,697, entitled COOLED INFRARED SENSOR ASSEMBLY WITH COMPACT CONFIGURATION, by Bin-Nun et al. filed even dated herewith;

Ser. No. 11/433,689, entitled FOLDED CRYOCOOLER DESIGN, by Bin-Nun et al. filed even dated herewith;

the entirety of each of which is incorporated herein by reference.

BACKGROUND OF THE INVENTION

1. Field of the Invention

The invention provides an improved refrigeration device. In particular, the improved refrigeration device includes one or more thermal regenerator for exchanging thermal energy with a refrigeration gas with at least one of the thermal regenerator disposed distal from the cold end of the device.

2. Description of Related Art

A cryogenic refrigeration device includes a sealed working volume filled with a working refrigeration fluid, e.g. comprising helium gas. Such a device may be used to cool an element to temperatures below 100° K. (degrees Kelvin). An example refrigeration device 10 of the prior art is shown in section view in FIG. 1. The device 10 is a miniaturized refrigeration device includes a gas compression unit 12 and a volume control unit 14. The compression unit 12 and volume control unit 14 are interconnected by a first fluid conduit 16. The sealed working volume of the example device at least includes the internal volumes of the compressor unit 12, the fluid conduit 16 and the volume control unit 14. Miniature cryogenic refrigeration devices are commercially available that are configured with the gas compression unit, the volume control unit, and the fluid conduit all integrally formed in a unitary assembly such as a crankcase. Examples of these devices are disclosed in U.S. Pat. No. 3,742,719 by Lagodmos, in U.S. Pat. Nos. 5,197,295 and 4,514,987 by Pundak et al, in U.S. Pat. No. 6,327,862 by Hanes, and in U.S. Pat. No. 4,858,442 by Stetson.

Other miniature cryogenic refrigeration devices are commercially available that are configured with the gas compression unit separate from the volume control unit, and with the fluid conduit extended between the separated units. Examples of these devices are disclosed in U.S. Pat. Nos. 5,596,875 and 4,024,727 by Berry et al., in U.S. Pat. No. 4,711,650 by Farie et al. and in U.S. Pat. No. 6,397,605 by Pundak.

In FIG. 1, the conventional gas compression unit 12 comprises a compression cylinder bore 18 formed within a surrounding crankcase 20 and a cylindrical compression piston 22 movably disposed within the compression cylinder bore 18 and movable in response to a driving force applied to the compression piston 22 by a drive link 24. A cylinder head 26 attaches to the crankcase 20 to seal a compression end of the cylinder bore 18. A cylindrical compression volume 28 is formed at the compression end of the cylinder bore 18 between the piston 22 and the cylinder head 26. Reciprocal movement of the piston 22 along a longitudinal axis of the cylinder bore 18 cyclically varies the volume of the compression volume 28, and consequentially cyclically varies the volume of the entire working volume. Accordingly, movement of the piston 22 generates a pressure wave that propagates through the working volume. The pressure wave is generated in the compression volume 28 and propagates through the first fluid conduit 16 to the volume control unit 14 and through the volume control unit 14 to a sealed end thereof. The pressure pulse is reflected by the sealed end and propagates back towards the compression volume 28. Accordingly, the refrigeration gas flows bi-directionally through the working volume with peak pressure amplitudes occurring as the piston 22 is driven toward the cylinder head 26 and with minimum pressure amplitudes occurring as the piston 22 is drawn away from the cylinder head 26.

The volume control unit 14 comprises a cylinder housing 30 formed to surround a longitudinal bore or cylinder 32. The cylinder 32 is open at one end to receive a gas displacing piston 36 therein and is sealed at a closed end by an end cap 34. The gas displacing piston 36 is movable within the cylinder 32 and is reciprocally driven along the cylinder longitudinal axis by a drive link 38. Movement of the gas displacing piston 36 cyclically varies the volume of a gas expansion space 40 formed between the inner most end of the gas displacing piston 36 and the end cap 34. Each cycle of the refrigeration device 10 cools refrigeration gas contained within the expansion space 40. An element to be cooled 42 attaches to the end cap 34 and cooled by the refrigeration gas inside the expansion space 40. A fluid port 44 provides fluid communication between the first fluid conduit 16 and the cylinder 32.

A fluid control module, generally designated F, receives high pressure refrigeration fluid from the compression unit 12 through the port 44. Elements of the cylinder housing 30 and the gas displacing piston 36 combine to provide a clearance seal at the open end of the cylinder 32, which prevents refrigeration gas from escaping from the cylinder 32 while still allowing movement of the gas displacing piston 36. The gas displacing piston 36 is configured with internal fluid passages 46 extending from the port 44 to a regenerator R, described below.

A regenerator module R comprises an insulating regenerator tube 48 formed as a fluid conduit and filled with a regenerator matrix 50 comprising a porous solid material configured to exchange thermal energy with the refrigeration gas as the gas flows through the regenerator tube 48. The regenerator module R receives incoming warm refrigeration gas at high pressure from the fluid control module F. The refrigeration gas flows through the regenerator tube 48 and exchanges thermal energy with the regenerator matrix 50 before flowing into the expansion space 40. On a return path, cold low pressure refrigeration gas exiting from the expansion space 40 flows through the regenerator module R, cooling the regenerator matrix 50 before flowing back to the compression unit 12.

A thermal barrier T, designated schematically by the dashed line in FIG. 1, comprises one or more thermally insulating elements disposed to prevent thermal conduction across the thermal barrier T. Generally elements on the warm side of the thermal barrier T are at the local ambient temperature, or a higher temperature due to heat dissipation in the compression unit 12 and drive motors, not shown, and elements on the cold side of the thermal barrier T are below the ambient temperature. During operation, the expansion space 40, also called a cold tip or cold end, is maintained at a cryogenic temperature, e.g. 77° K., while the fluid control module F and the compression unit 12 remain substantially at the local ambient temperature, e.g. 270° K. Accordingly, a very steep thermal gradient extends along the longitudinal length of the regenerator module R.

It is well understood that using a regenerator module R to pre-cool refrigeration gas or another working fluid as it flows from the compression unit 12 to the expansion space 40 increases the cooling power that can be delivered to the element to be cooled 42. In addition, pre-heating refrigeration gas as it flows from the expansion space to the compressor improves the efficiency of the refrigeration device. Ideally a regenerator module R is designed for 100% effectiveness which means that the regenerator module completely pre-cools, or pre-heats, the refrigeration gas flowing along its length. In particular, 100% effectiveness occurs when warm refrigeration gas entering the regenerator module at the warm end exits the regenerator module at the cold end at the cooling temperature of the device, e.g. 77° K. When this is the case, substantially all of the cooling power generated by expanding the expansion space 40 volume is available to be delivered to the device to be cooled 42 and none of the cooling power generated by the device is needed to further cool the entering refrigeration gas. Conversely, 100% effectiveness occurs when cold refrigeration gas entering the regenerator module at the cold end exits the regenerator module at the warm end at the local ambient temperature, e.g. 270° K. When this is the case, substantially all of the cooling available from the cold refrigeration gas is transferred to the regenerator matrix 50. Analytical models have shown that any reduction in the effectiveness of the regenerator greatly degrades the cooling power of the refrigeration device. In one example, Applicants calculated that a conventional refrigeration device of the type shown in FIG. 1 may be reduced to 80% of its potential cooling power when the regenerator matrix is 99% effective instead of 100% effective.

It is further understood that the effectiveness of a regenerator is a function of the magnitude of the total surface area of surfaces of the regenerator matrix substrate that contact working fluid and further that the total surface area is strongly dependent upon the longitudinal length L of the regenerator module R. Heretofore is has been a hard design requirement of a miniature cryocooler refrigeration system that the regenerator matrix 50 be configured with sufficient longitudinal length L for making a 100% effective thermal energy exchange with the refrigeration gas flowing along its length. However this hard design requirement is in conflict with reducing the size of the refrigeration device 10.

Generally there is a need in the art to further miniaturize refrigeration devices or at least to further miniaturize the volume control unit 14 to deliver cooling power to smaller elements to be cooled 42 or to fit the refrigeration device 10 or the volume control unit 14 within smaller volume enclosures. A major barrier to reducing the size of the refrigeration device 10 or the size of the volume control unit 14 has been an inability to reduce the longitudinal length L of the regenerator matrix 50 while still providing a 100% thermal energy exchange with the working fluid.

Heretofore, miniature refrigeration devices like the one shown in FIG. 1 have employed a single regenerator matrix 50 disposed in the regenerator module R and more specifically with the entire longitudinal length L of the regenerator module disposed on the cold side of the thermal barrier T. Such a system configuration is not easily miniaturized. According to the present invention, the overall size of a refrigeration device is reduced by configuring the device with a longitudinal length L of a regenerator matrix disposed on the cold side of the thermal barrier to a length L that is less than a length L required for 100% effectiveness and other regenerator modules are disposed on the warm side of the thermal barrier T to add further regenerating capacity as may be required to provide 100% regenerator effectiveness.

BRIEF SUMMARY OF THE INVENTION

The present invention overcomes the problems cited in the prior art by providing a refrigeration device configured with a first regenerator module disposed on a cold side of a thermal barrier and a second regenerator module disposed on a warm side of the thermal barrier and a thermally insulated fluid flow passage disposed to interconnect the first and second regenerators.

In one example a first regenerator module (R) is disposed in a regenerator portion of a movable gas displacing piston (138) and a second regenerator module ($R_1$) is disposed in a fluid control unit (152) of the movable gas displacing element (138). Cold refrigeration gas enters the first regenerator module (R) from an expansion space (142) and cools a thermal regenerator substrate contained therein. However, the first regenerator module does not provide a 100% thermal energy exchange with the refrigeration gas.

A thermal barrier (T) is disposed between the first regenerator module (R) and the second regenerator module ($R_1$). The thermal barrier T includes insulating elements disposed to create a high resistance to thermal energy conduction between the first regenerator module (R) and the second regenerator module ($R_1$). Refrigeration gas exiting the first regenerator module is below the local ambient temperature so a fluid conduit connecting the first regenerator module and the second regenerator module is insulated to prevent the refrigeration gas flowing therein to become warmed by surrounding elements. In addition the second regenerator module $R_1$ is also insulated to prevent the refrigeration gas flowing there through and to prevent the regenerator matrix material contained therein from being warmed by surrounding elements. The second regenerator module $R_1$ completes the thermal energy exchange with the refrigeration gas as it flows through such that refrigeration gas exits the second regenerator module $R_1$ at the local ambient temperature. The first and second regenerator modules combine to complete a 100% effective thermal energy exchange with the refrigeration gas.

BRIEF DESCRIPTION OF THE DRAWINGS

The features of the present invention will best be understood from a detailed description of the invention and a preferred embodiment thereof selected for the purposes of illustration and shown in the accompanying drawing in which.

DETAILED DESCRIPTION OF THE INVENTION

Figure 2:
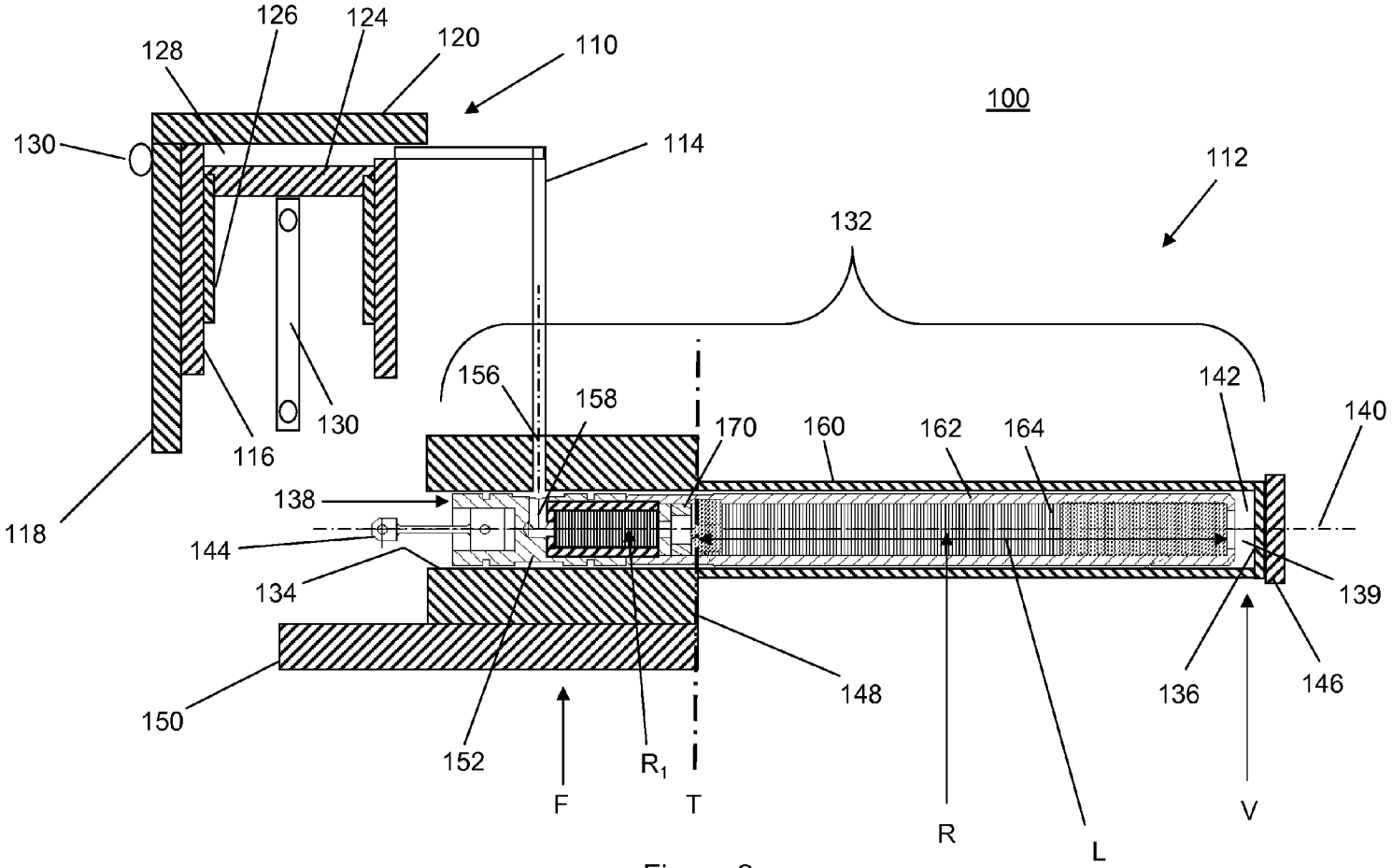
FIG. 2 illustrates a section view taken through portions of an improved refrigeration device utilizing two regenerator modules according a preferred embodiment of the present invention.

FIG. 2, depicts a section view taken through portions of a preferred embodiment of an improved refrigeration device 100 according to the present invention. The device 100 includes a sealed working volume filled with a working refrigeration fluid such as helium gas; however, other working fluids are usable. In particular, the refrigeration device 100 includes a gas compression unit 110 and a gas volume expansion unit 112. The compression unit 110 and volume expansion unit 112 are fluidly interconnected by a first fluid conduit 114, and the combined internal volume of these elements forms the working volume. The device 100 is constructed to establish a thermal barrier T which substantially blocks thermal conduction from crossing the dashed line shown in FIG. 2 to demark an approximate boundary between a warm side of the device shown on the left in FIG. 2 and a cold side of the device, shown on the right in FIG. 2. During operation, elements on warm side of the thermal barrier T substantially remain at the local ambient temperature while elements on the cold side of the thermal barrier T are cooled to temperatures that are substantially below the local ambient temperature. However, according to a first embodiment of the present invention, shown in FIG. 2 and described below, a first regenerator module R is disposed on the cold side of the thermal barrier T and a second regenerator module $R_1$ is disposed on the warm side of the thermal barrier T. In further embodiments of the present invention, shown in FIGS. 4 and 5, a first regenerator module R is disposed on the cold side of the thermal barrier T a third regenerator module $R_2$ is disposed on the warm side of the thermal barrier T.

As shown in FIG. 2, the gas compression unit 112 comprises a conventional gas compressor formed with a compression cylinder 116 bored in a crankcase support 118 and sealed by a cylinder head 120. A compression piston comprises a disk shaped piston head 124 and an annular piston side wall 126. An outside diameter of the piston side wall 126 is sized to fit within the compression cylinder 116 with a gas sealing clearance fit. The gas sealing clearance fit comprises an annular gap, not shown, between the compression cylinder 116 and the side wall 126 and the annular gap dimension is sized to substantially prevent pressurized refrigeration gas from escaping from the compression cylinder 116 while still providing sufficient clearance to allow movement of the piston 122 with respect to the cylinder 116. In particular, the annular gap dimension may be in the range of 0.001-0.0015 mm, (50-100 micro inches) and the gap dimension may be formed even smaller when practical forming techniques allow it.

A cylindrical gas compression volume 128 is formed in the compression cylinder 116 between the piston head 124 and the cylinder head 120. The piston 122 is reciprocally moved within the compression cylinder 116 to cyclically vary the volume of the gas compression volume 128. The piston movement generates a pressure pulse within the working volume and the pressure pulse reaches maximum pressure amplitude as the piston is advancing toward the cylinder head 120. Conversely, the pressure pulse reaches minimum pressure amplitude when the piston is being drawn away from the cylinder head 120.

The pressure pulse propels refrigeration gas out of the compression unit 110, through the first fluid conduit 114 and into the volume expansion unit 112. The pressure pulse may also reflect from a sealed end of the volume expansion unit 112 causing refrigeration gas to flow back toward the compression unit 112 during the low amplitude phase of the pressure pulse. In other embodiments of the refrigeration device 100, such as a Vuilleumier refrigerator, a heating element 130 may be mounted proximate to the compression volume 128 to further increase the pressure of the working fluid by heating it.

Volume Expansion Unit

The gas volume expansion unit 112 generally comprises a fluid control module F, shown on the left in FIG. 2, a first regenerator module R, a second regenerator module $R_1$, housed within the fluid control module F, and a volume expansion module V, shown on the right in FIG. 2. The fluid control module F is in fluid communication with the first fluid conduit 114 and with the first regenerator module R such that working fluid flows bi-directionally through the fluid control module F and through the second regenerator module $R_1$ housed therein. The fluid control module F also seals an open end of the volume expansion unit 110 to prevent pressurized refrigeration gas from escaping from the expansion unit 112.

The first regenerator module R is in fluid communication with the fluid control module F and the expansion module V such that working fluid flows bi-directionally through the first regenerator module R. Each of the first and second regenerator modules comprise a fluid conduit filled with a porous solid regenerator matrix such that working fluid flowing through the regenerator modules flows through the regenerator matrices. As the working fluid flows through each regenerator matrix thermal energy is exchanged between the working fluid and the corresponding regenerator matrix.

The volume expansion module V receives working fluid from the first regenerator module R. The volume of the volume expansion module V is configured to be expandable, substantially in phase with peaks in pressure pulse amplitude of the working fluid, to generate cooling power by a refrigeration effect that occurs by expanding the volume of the pressurized refrigeration gas. An element to be cooled 146 is positioned proximate to the volume expansion module V and is cooled by the cooling power generated therein. When the volume expansion module V is collapsed, the refrigeration gas is forced to flow out of the volume expansion module V and back towards the compression unit 110 through the first regenerator module R.

The volume expansion unit 112 comprises a cylinder housing 132 formed with contiguous annular wall sections enclosing a cylindrical volume or volume expansion cylinder 134. The cylinder 134 extends along the entire longitudinal length of the cylinder housing 132 and is open at a warm end thereof, shown on the left side of FIG. 2, and closed and pressure sealed by an end cap 136, attached to the annular wall sections at a cold end thereof, shown on the right of FIG. 2.

Figure 3:
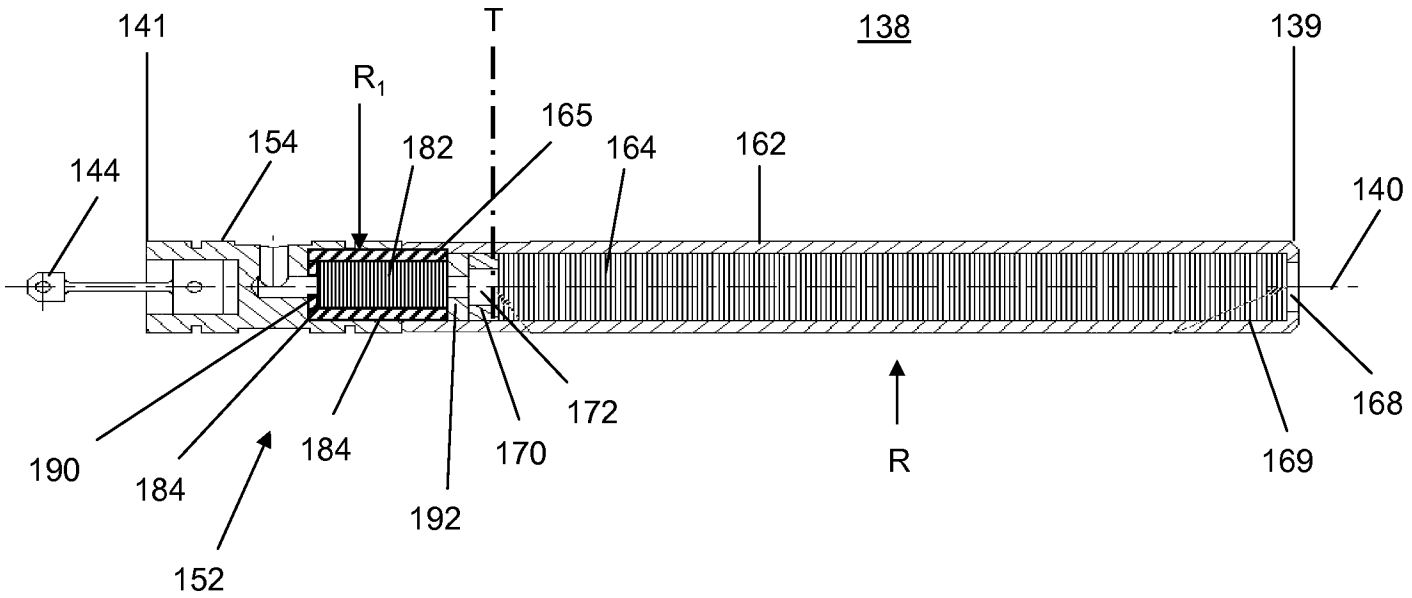
FIG. 3 illustrates a section view taken through an improved gas displacing piston utilizing two regenerator modules according to a preferred embodiment of the present invention.

The volume expansion unit 112 further comprises a gas displacing piston generally indicated by the reference numeral 138, and shown in detail in FIG. 3. The gas displacing piston 138 installs into the cylinder 134 through the open warm end and is movable with respect to the cylinder housing 132 along a longitudinal axis 140 of the cylinder 134. The gas displacing piston 138 includes a cold end 139 installed innermost in the cylinder 134 and a warm end 141 being driven by a drive link 144. The gas displacing piston 138 has a longitudinal length that is sized to fill the cylinder 134 except for a hollow volume at the cold end of the cylinder 134. The hollow volume comprises the volume expansion module V defined by a variable volume gas expansion space 142 that extends from the cold end 139 to the end cap 136.

The volume of the gas expansion space 142 varies as the gas displacing piston 138 is reciprocally moved over a stroke distance by a drive link 144. A drive element, not shown, couples with the drive link 144 to move the gas displacing piston 138 in accordance with a desired pattern. The pattern of movement is synchronized, although phase separated, with movement of the motion of the gas compression piston 122 for generating refrigeration cooling within the expansion space 142. An element to be cooled 146 is attached to the end cap 136 and thermal energy may be removed from the element to be cooled 146 during each cooling cycle of the refrigeration device.

Cylinder Housing

The cylinder housing 132 comprises a pressure vessel for containing pressurized refrigeration fluid formed by a first tube element 148, a second tube element 160 and the end cap 136. The first tube element 148 comprises a thick annular wall with a longitudinal bore passing along its length for forming a portion of the cylinder 134 and for forming the outer housing of the fluid control module F. The first tube element 148 is supported by a support structure 150 which may be unitary with the gas compression unit crankcase 118. Alternately, the first tube element 148 may comprise a cylinder bore formed directly in the crankcase 118. In other configurations, the support structure 150 may comprise a separate support element, e.g. when the volume expansion unit 112 and the gas compression unit 110 are formed as separate elements (split) connected by the fluid conduit 114.

The second tube element 160 comprises a thin-walled expansion tube having a warm end attached to the first tube element 148 and a cold end cantilevered from the first tube element 148. The second tube element 160 is cantilevered from the first tube element 148 and support structure 150 to thermally isolate the cold end from warm element. A disk-shaped end cap 136 is joined to second tube element 160 at its cold end. The first tube element 148, the second tube element 160 and the end cap 136 are each formed from metal e.g. stainless steel, to provide the needed strength and stiffness for forming the cylinder housing 132 which is a pressure vessel. In a preferred embodiment the first and second tubes 148 and 160 are joined together by a continuous laser weld and the end cap 134 is joined to the second tube by a continuous laser weld to ensure that the cylinder 134 is pressure sealed. However, other pressure sealing joining techniques are usable.

The entire length of the second regenerator tube 160 extends to the cold side of the thermal barrier T which as shown in FIG. 2 is substantially located at the joint between the first and second tube elements. Accordingly, the second tube element 160 is specifically configured with a thin wall, e.g. less than 0.0004 mm, (0.010 inches) to provide a high resistance to the conduction of thermal energy along the longitudinal direction defined by 140. However, the thin wall readily conducts thermal energy in the radial direction. The element to be cooled 146 is attached to the end cap 136 and the end cap 136 is configured to conduct thermal energy away from the device to be cooled 146 and toward cold refrigeration gas contained within the expansion space 142.

Gas Displacing Piston

The gas displacing piston 138, shown in section view in FIG. 3, comprises a fluid control element 152 disposed at the warm end 141 and the fluid control element 152 cooperates with the first tube element 148 to seal the cylinder 134 and to support the gas displacing piston 138 for movement within respect to the cylinder 134. The fluid control element 152 includes spaced apart annular bearing surfaces 154 disposed on opposite sides of a fluid port 156, and the annular bearing surfaces 154 are form fitted to match the diameter of the cylinder 134 to provide a gas clearance seal. The gas clearance seal prevents pressurized refrigeration gas from escaping from the cylinder 134 while still allowing movement of the gas displacing piston 138 along the longitudinal axis 140. The radial clearance of the gas clearance seal may be in the range of 0.001-0.0015 mm, (50-100 micro inches), or less, if it can be achieved by a practical process.

The fluid control element 152 further includes a blind bore extending from and sized to receive the second regenerator 182 therein. A connecting passage 158, shown in FIG. 2, extends from a radial surface of the fluid control element 152 to the blind bore and provides a fluid passage from the blind bore to the port 156. Accordingly, refrigeration gas entering the port 156 from the first fluid conduit 114 flows into the connecting passage 158, into the blind bore through the second regenerator module 182 ($R_1$ in FIG. 2) and exits to the first regenerator module R.

First Regenerator Module

The first regenerator module R is integral with the gas displacing piston 138 and comprises an insulating regenerator tube 162 which forms a fluid passage that extends from the fluid control module F to the expansion space 142. The fluid passage is filled with a porous solid regenerator matrix material 164 configured to exchange thermal energy with the working fluid as it flows through the insulating tube. An outside diameter of the regenerator tube 162 is sized to provide a slight clearance fit with respect to the cylinder 134; however the cold end of the tube 162 may include a raised bearings surface 166 for bearing against the wall of the cylinder 134 during movement with respect thereto.

As shown in FIG. 3, a warm end of the regenerator tube 162 attaches to the fluid control unit 152 by fitting over a land diameter 165 of the fluid control unit 152. The regenerator tube 162 is formed from a thermally insulating material such as an epoxy resin filled with glass fibers, e.g. G10, FR4 or Ryton. Such materials provide a high resistance to thermal conduction in both the radial and longitudinal directions. Accordingly, thermal conduction across the contacting surfaces of the fluid control unit 152 and the regenerator tube 162 is substantially minimized. In a preferred embodiment, Ryton is used which comprises 40% fiberglass reinforced Poly-Phenylene Sulfide.

Figure 6A:
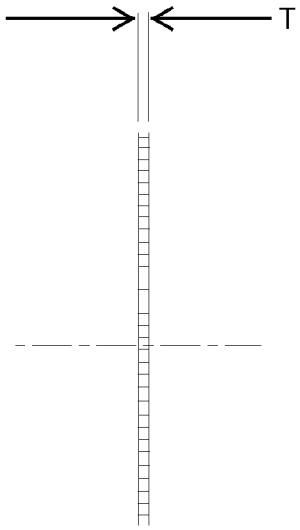
FIG. 6A illustrates a preferred regenerator element shown in side view.
Figure 6B:
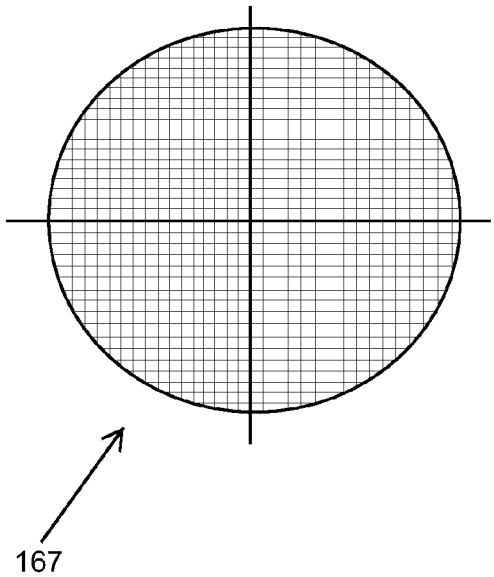
FIG. 6B illustrates a preferred regenerator element shown in top view.

The regenerator tube 162 is filled with a regenerator matrix 164. In a preferred embodiment, the regenerator matrix 164 comprises a plurality of disk-shaped elements formed from interwoven metallic wire. An example disk-shaped element 167 is shown in FIGS. 6A and 6B. Each disk shaped element comprises a plurality of metallic wire strands woven together with a weave pattern such as a plain or a twill weave pattern. In a preferred embodiment, the wire strands have a diameter in the range of 0.012-0.050 mm, (0.0005-0.002 inches) and the wires are interwoven with a pitch of approximately 16 wires per mm, (400 wires per inch), i.e. with a center-to-center wire separation of approximately 0.064 mm, (0.0025 inches). The preferred wire material is round stainless steel wire. The regenerator matrix 164 is formed by stacking disk elements one above another to fill the regenerator tube 162 along its entire longitudinal length. Depending on the longitudinal length of the regenerator tube 162, the thickness of each disk and the pressure force applied to compact and hold the disks within the regenerator tube 162, the regenerator matrix 164 may comprise between 600 and 1000 disk-shaped elements. In a preferred embodiment the diameter of each disk is approximately 4.8 mm, (0.188 inches) however larger or small diameter regenerator matrix configurations are usable without deviating from the present invention. While any regenerator matrix material may be usable with the present invention, specific examples of thermal regenerator matrix configurations usable with the present invention are disclosed in disclosed in co-assigned U.S. patent application Ser. No. 10/444,194, by Bin-Nun et al. entitled LOW COST HIGH PERFORMANCE LAMINATE MATRIX, filed on May 23, 2003, published as US2004/0231340, the entirety of which is hereby incorporated herein by reference.

The regenerator tube 162 includes and end cap 168 attached thereto at the cold end to hold the regenerator matrix material inside the regenerator tube 162. The end cap 168 is made with features used to attach it to the tube 162 and is provided to hold the regenerator material inside the regenerator tube 162. The end cap 168 is porous to provide fluid passages from the regenerator matrix 164 to the expansion space 142 and the porosity of the fluid passages may be configured to control flow of working fluid into and out of the regenerator matrix 164. In addition, the raised bearing surface 166 may be formed on the end cap 168 instead of on the end of the regenerator tube element 160.

One or more thermally insulating disks 170 are installed within the regenerator tube 162 to capture the regenerator matrix elements in place at the warm end and to provide a high resistance to thermal conduction between the regenerator matrix 164 and elements of the fluid control module F or elements or the second regenerator module $R_1$. Each insulating disk 170 includes a flow aperture 172 passing through its center and through which working fluid flows into and out of the regenerator matrix 164. The insulating disks may be formed from Ryton or another thermally insulating material.

Second Regenerator

The second thermal regenerator module $R_1$ is disposed within the fluid control unit 152 which is on the warm side of the thermal barrier T. However, according to the present invention, an additional thermal barrier is formed to surround the second regenerator module $R_1$. The second regenerator module $R_1$ is generally constructed like the first regenerator module R and includes a thermally insulating hollow exterior shell portion that forms a fluid conduit along it longitudinal length and provides fluid flow apertures at each end thereof. The exterior shell portion is formed from a thermally insulating material such as an epoxy resin filled with glass fibers, e.g. G10, FR4 or Ryton, with Ryton being the preferred enclosure material. The shell portion is filled with a second regenerator matrix 182 configured to exchange thermal energy with the working fluid as it flows through it.

As shown in section in FIG. 3, the shell portion comprises a unitary hat shaped enclosure element comprising a surrounding annular side wall 184 formed to surround a hollow cylindrical cavity along its longitudinal length and a top wall 188. The cavity is opened at its bottom end and the top wall 188 includes a fluid flow aperture 190 passing through it. A base of the annular wall 184 is terminated by an annular shoulder 192 extending radially outward from the annular wall 184. The annular shoulder 192 provides an insulating seat for contacting a bottom edge of the fluid control element 152 and for providing a high resistance to thermal conduction between elements of the fluid control module F and the regenerator module R.

The second thermal regenerator module $R_1$ is filled with a regenerator matrix substrate 186 which may comprise any regenerator matrix but which preferably formed by a plurality of disk-shaped element like the element 167 shown in FIGS. 6A and 6B. Each disk-shaped element 167 of the second regenerator matrix 186 is formed with a diameter that closely matches the inside diameter of the annular wall 184 and the disks 167 are stacked one above another to entirely fill the cavity 186. As described above, each disk-shaped elements 167 may be formed from plurality of metallic strands of stainless steel wire with a diameter in the range of 0.012-0.050 mm, (0.0005-0.002 inches) woven together with a plane or twill weave pattern a pitch of approximately 16 wires per mm, (400 wires per inch), i.e. with a center-to-center wire separation of approximately 0.064 mm, (0.0025 inches). Depending on the cavity longitudinal length, the thickness of each disk and the pressure force used to compact the disks within the annular wall 180, the second regenerator matrix 186 may comprise between 50-200 disk-shaped elements.

In a preferred embodiment of the present invention the diameter of each disk of the second regenerator matrix 186 has an approximate diameter of 2.54 mm, (0.1 inches); however larger or small diameter regenerator matrix configurations are usable without deviating from the present invention. In addition, the disk-shaped elements of the second regenerator matrix 186 may be installed into the cavity 186 with the weave pattern of each disk being randomly oriented, or with the weave pattern of alternating disks being aligned with a desired orientation.

Drive Motor

In a preferred embodiment of the present invention a single rotary drive motor, not shown, is coupled to the compression unit drive link 130 and to the gas displacing piston drive link 152. With each full revolution of the drive motor each of the compression piston 122 and gas displacing piston 138 traverses a round trip reciprocal motion over its designed stoke distance. The reciprocal motion of the compression piston 122 alternately expands and contracts the volume of the compression volume 126 to generate gas pressure pulses while the reciprocal motion of the gas displacing piston 138 alternately expands and contracts the volume or the expansion space 142 to generate a refrigeration effect. Generally, the motion of the two pistons is phased to position the compression piston 122 at its maximum compression stroke (i.e. to minimize the compression space volume) just as the gas displacing piston 138 begins moving to expand the volume of the expansion space 142. Generally, the preferred refrigeration device 100 operates as Stirling refrigeration device such as the one disclosed in commonly assigned U.S. Pat. No. 4,858,442 by Stetson, the entire content of which is hereby incorporated herein by reference. An example rotary DC motor and coupling a coupling device usable with the present invention is disclosed in co-pending and commonly assigned U.S. patent application Ser. No. 10/830,630, by Bin Nun et al., filed on Apr. 23, 2004, entitled REFRIGERATION DEVICE WITH IMPROVED DC MOTOR, the entire content of which is hereby incorporated herein by reference.

Accordingly, working fluid, e.g. a refrigeration gas comprising helium, at high pressure is forced from the gas compression volume 128 to the second regenerator $R_1$ which starts to pre-cool the gas. Thereafter the refrigeration gas enters the first regenerator module R which further pre-cools the refrigeration gas which then flows into the expansion space 142, which is at a minimum volume condition. When the expansion space 142 is filled with high pressure refrigeration gas the gas displacing piston 138 is moved to increase the volume of the expansion space 142 and the refrigeration gas contained therein is cooled. As the gas displacing piston 138 is moved to decrease the volume of the expansion space 142, the cold refrigeration gas is expelled from the expansion space 142 and flows through the first regenerator module R and the cold refrigeration gas cools the regenerator matrix 164. The refrigeration gas next flows through the second regenerator module $R_1$ and cools the regenerator matrix 182.

Energy Exchange

As stated above, a thermal regenerator matrix is considered 100% effective when a volume of cold refrigeration gas enters the regenerator matrix at a cold temperature of the device and exits the regenerator matrix a warm temperature of the device. Conversely, a thermal regenerator matrix is considered 100% effective when a volume of warm refrigeration gas enters the regenerator matrix at a warm temperature of the device and exits the regenerator matrix a cold temperature of the device. In the refrigeration device 100, the cold temperature of the device is approximately 77° K., which is the temperature of the refrigeration gas contained within the expansion space 142, and the warm temperature is substantially the local ambient temperature, e.g. 270° K. Of course the local ambient temperature may vary according to the location and application of the device 100 and the warm temperature of the device may be slightly elevated with respect to the local ambient temperature due to thermal dissipation of electrical and mechanical elements of the device 100 and the actual warm temperature may be in the approximate range of 220°-320° K.

According to the invention, the device 100 includes two distinct and separate regenerator modules R and $R_1$ and each regenerator R and $R_1$ has a regenerator effectiveness capacity that is less than 100%. However, the combined regenerator effectiveness capacity of the two regenerator matrices 164 and 182 provides a 100% effective thermal energy exchange with the refrigeration gas flowing through the device 100. Specifically, the first regenerator module R includes a regenerator matrix 164 that is configured with a longitudinal length L that is less than a length L that is required to provide a 100% effective thermal energy exchange by the matrix 164. The length L of the regenerator matrix 164 is specifically shortened to further miniaturize the refrigeration device 100 by shortening the length of the volume expansion unit 112. Accordingly, the first regenerator module R is less than 100% effective by design.

To add additional regenerator capacity to the device 100, the second regenerator module $R_1$ is provided in the flow path of the refrigeration gas, between the gas expansion space 142 and the gas compression volume 128. The second regenerator module $R_1$ is disposed inside the fluid control unit 152 which allows the addition of regenerator effectiveness capacity without increasing the volume of the device 100 or the length of the volume expansion unit 112. However, the second regenerator module $R_1$ is located on the warm side of the thermal barrier T and is therefore surrounded by ambient temperature elements at approximately 220°-320° K. Accordingly, the second regenerator module $R_1$ is enclosed with a thermally insulating enclosure to thermally isolate the regenerator matrix 182 and the refrigeration gas flowing therethrough and to block thermal conduction to the second regenerator matrix 182.

The combined thermal regenerator effectiveness of the first regenerator module R and the second regenerator module $R_1$ provides a 100% effective thermal energy exchange with the refrigeration gas. In particular, the device 100 is configured such that the refrigeration gas at a temperature of approximately 77° K. enters the regenerator matrix 164 and flows along it length L. The gas exits the regenerator matrix 164 at a temperature that is below the local ambient temperature. The gas then enters the second regenerator matrix 182 and flows along its length and exits the regenerator matrix 182 substantially at the same temperature as the local ambient temperature, e.g. approximately 270° K. In this case, both regenerator matrices 164 and 182 are cooled by the refrigeration gas flowing from the expansion space 142 to the compression volume 128 and both regenerator matrices 164 and 182 pre-cool the refrigeration gas as it flows from the compression volume 128 to the expansion space 142.

The effectiveness of a thermal regenerator matrix is strongly dependent upon the total surface area of matrix elements making contact with the refrigeration gas as it flows through the matrix, by the flow velocity of the gas flowing through the matrix, and by the thermal energy exchange characteristics of the matrix substrate. With other parameters remaining constant, the longitudinal flow length of a regenerator matrix is directly proportional to is regenerator effectiveness. In the device 100, the second regenerator matrix 182 is configured to provide a regenerator effectiveness capacity that is equal to a length ΔL of the regenerator matrix 164. Accordingly, the addition of the second regenerator matrix 182 allows the first regenerator matrix 164 to be shortened by a length ΔL without a reduction in regenerator matrix effectiveness of the system.

Figure 1:
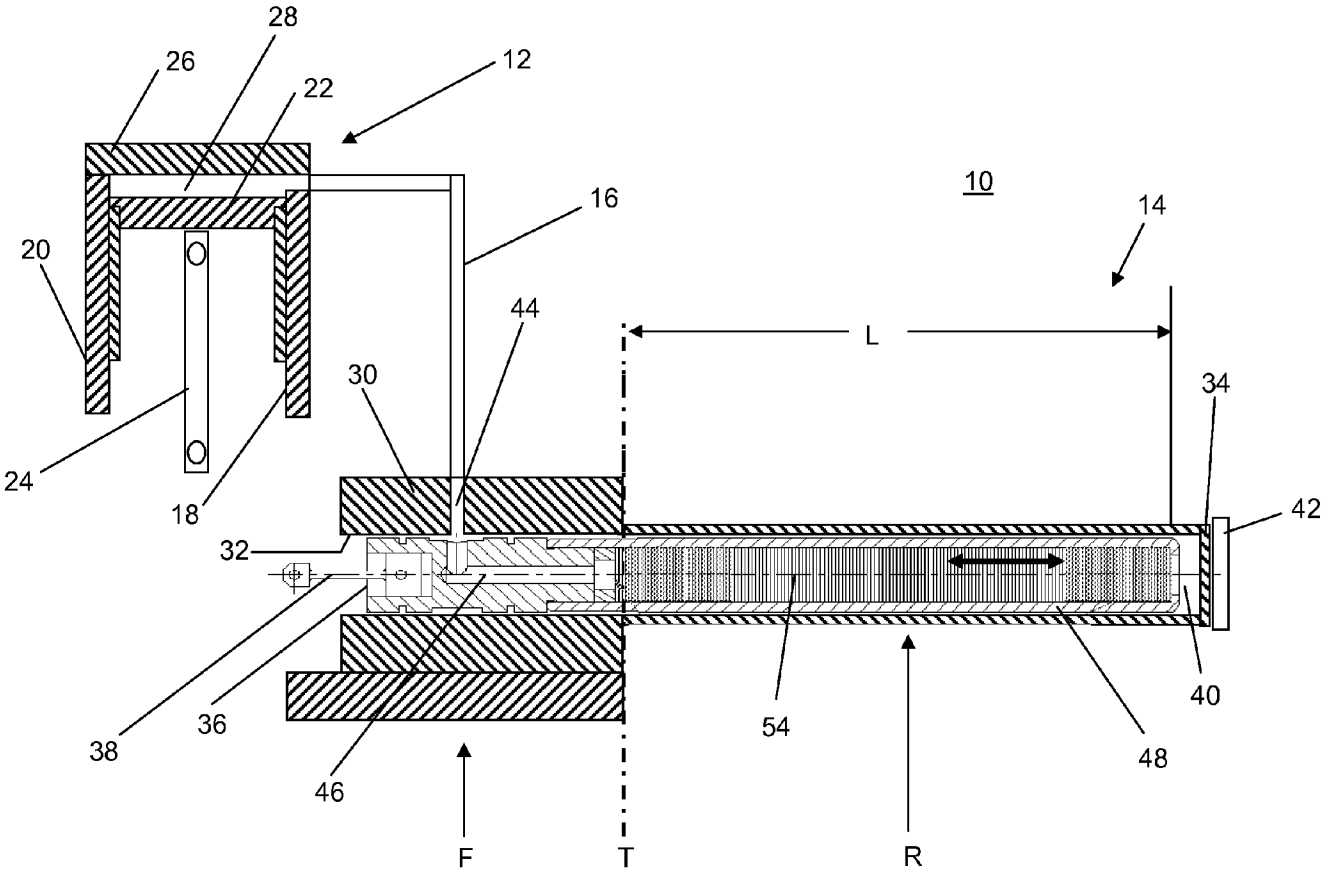
Figure 1 Prior Art
FIG. 1 illustrates a section view taken through portions of conventional refrigeration device.

In the particular example of a preferred embodiment of the present invention, the first regenerator matrix 164 has a longitudinal length of 34.45 mm, (1.36 inches) and comprises approximately 600-1000 disk-shaped elements each having a diameter of 4.8 mm, (0.19 inches). The second regenerator matrix 186 has a longitudinal length of approximately 12.7 mm, (0.5 inches) and comprises approximately 50-500 disk-shaped elements each having a diameter of 2.54 mm, (0.1 inches). The regenerator effectiveness of the second regenerator matrix 186 is equivalent to the regenerator effectiveness of a length ΔL of the first regenerator matrix 164 and the length ΔL is equal to approximately 4.7 mm, (0.183 inches). Accordingly, the length of the volume expansion unit 112 of the improved refrigeration device 100 of the present invention is reduced by 4.7 mm, (0.183 inches) as compared to the conventional refrigeration device 10 of FIG. 1, which has substantially similar construction and performance characteristics as the device 200 but utilizing only a single regenerator module R.

Third Regenerator

Figure 4:
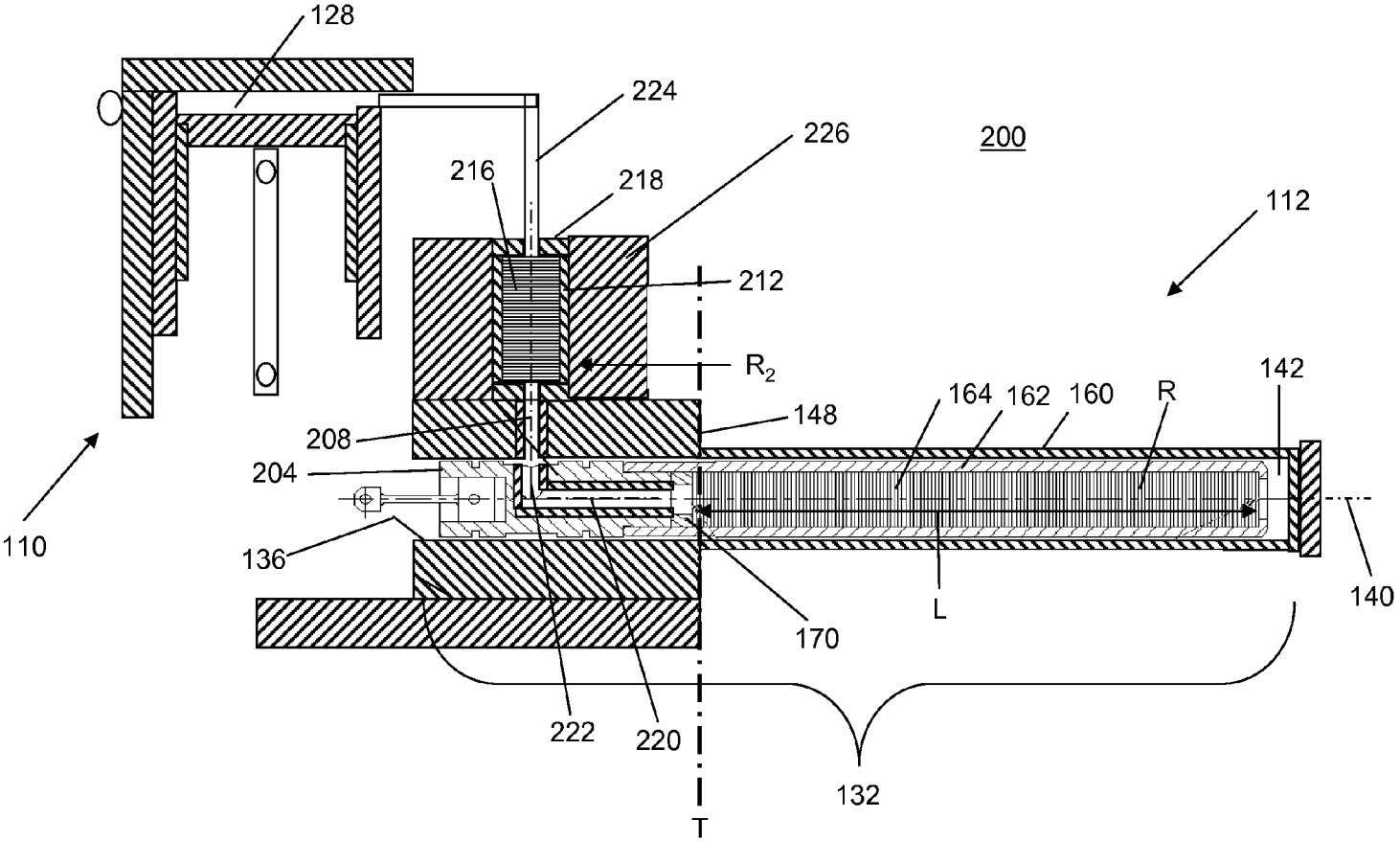
FIG. 4 illustrates a section view taken through portions of an improved refrigeration device utilizing two regenerator modules according to a second embodiment of the present invention.

In a further embodiment according to the present invention, a refrigeration device 200 is shown in FIG. 4. The refrigeration device 200 is generally configured similarly to the refrigeration device 100 and the same reference numbers are used to designate like elements. The device 200 includes a gas compression unit 110, with a gas compression volume 128, a gas volume expansion unit 112, with expansion cylinder housing 132 and cylinder 136 and with a gas expansion space 142 at its cold end, and with these elements similarly configured and operating on the same refrigeration cycle as is described above for the device 100.

The refrigeration device 200 includes a gas displacing piston that includes a fluid control element 204, configured to seal the warm end of the cylinder 136, and a first regenerator module R that extends from the fluid control element 204 to the expansion space 142. The first regenerator module R is identical to the first regenerator module R described above for device 100. The fluid control element 204 includes internal passages that extend from the insulating disks 170 to a fluid port 208. The fluid port 208 passes through a thick-walled first tube element 148 and interfaces with a third generator module $R_2$. The third regenerator module $R_2$ is disposed between the gas compression unit 110 and the volume expansion unit 112.

The third regenerator module $R_2$ comprises a thermally insulating tube 212 having an annular wall surrounding a hollow cylindrical cavity. The cavity is filled with a regenerator matrix material 216 for exchanging thermal energy with working fluid flowing through the cavity. The regenerator matrix 216 may comprise any regenerator matrix substrate material, but is preferably is formed by a plurality of stacked disk-shaped elements 167, as described above, with each disk-shaped element having a diameter formed to match an inside diameter of the cavity. At each end of the insulating tube 212 is disposed an insulating disk-shaped element 218. Each insulating disk-shaped element 218 includes a centered flow aperture formed therethrough to allow the bi-directional flow of refrigeration gas into and out of each end of the insulating tube 212. The insulating disks 218 substantially prevent thermal conduction between the matrix 216 and surrounding elements while also capturing the disk-shaped elements 167 within the cavity.

The internal passages of the fluid control element 152 include a blind longitudinal bore 220 and a radial bore 222. The radial bore 222 is formed along a radial axis of the fluid control element 204 and substantially aligns with the port 208. The longitudinal bore extends from the insulating disks 170 to the radial bore 222 and fluidly connects therewith. Accordingly, refrigeration gas flows bi-directionally from the first regenerator matrix 164 through the flow apertures or the insulating disks 170, through the longitudinal bore 220, the radial bore 222, the port 208, the through the insulating disks 218, through the cavity housing the third regenerator $R_2$ and through a fluid conduit 224 to the gas compression volume 128.

The longitudinal bore 220, the radial bore 222 and the fluid port 208 are each surrounded by a layer of thermally insulating material provided to substantially prevent the exchange of thermal energy between refrigeration gas flowing therethrough and the fluid control element 152 and the first tube element 148. The layer of thermally insulating material may comprise tube elements formed from thermally insulating material and cut to length to fit within the longitudinal bore 220, the radial bore 222 and the port 208. As shown in FIG. 4 the tubes installed in the longitudinal bore and radial bore are cut at 45 degree where they mate. Each tube may be formed an epoxy resin filled with glass fibers, e.g. G10, FR4 or Ryton. The thermally insulating tubes may be fastened in place, e.g. by a bonded joint or by a press fit.

The third regenerator $R_2$ may be disposed within a cylindrical cavity bored into a support element 226. The support element 266 is preferably the unitary crankcase 118 that supports both the compression unit 110 and the volume expansion unit 112. Alternately, if the compression unit 110 and volume expansion unit 112 are separated, the support element 226 may be formed integral with the first tube element 148, or may be independent of the crankcase 118 or the first tube element 148. In another embodiment, the third regenerator $R_2$ may be disposed at any position between the compression volume 128 and the port 208 with the fluid conduit 224 extending from each end of the third regenerator module $R_2$ to the compression volume 128 and the port 208.

Because the third regenerator module is disposed external to the gas compression unit 110 and the gas volume expansion unit 112 the cross-section and length of the third regenerator module $R_2$ are less restricted by volume constraints, especially in that case that the gas compression unit 110 and volume expansion unit 112 are separated. Accordingly, the refrigeration unit 200 may comprise a third regenerator $R_2$ configured with the same or greater regenerator effectiveness as the regenerator effectiveness of the first regenerator matrix R.

As an example, the first regenerator matrix 164 and the third regenerator matrix 216 may comprises identical disk-shaped elements 167 with each regenerator matrix being configured with elements having the same diameter, the same orientation characteristics and the same compacting force. In this case, the first and third regenerator matrices have substantially identical regenerator effectiveness per unit length. In this example, the length of the first regenerator matrix 164 can be reduced by amount equal to the length of the third regenerator matrix 216 in a configuration that can be used to even further reduce the length of the gas volume expansion unit 112. Another advantage of this example embodiment is that only one size regenerator screen is required and this provides a manufacturing cost savings.

As a further example, the third regenerator matrix 216 may comprises disk-shaped elements 167 having a greater diameter than the disk-shaped elements 167 of the first regenerator matrix 164 such that the regenerator effectiveness per unit length of the third regenerator matrix 216 is greater than the regenerator effectiveness per unit length of the first regenerator matrix 164. In this case, the length of the first regenerator matrix 164 can be reduced by an amount $\Delta L$ utilizing a third regenerator matrix 216 configured with a length that is less than the length $\Delta L$. This embodiment is especially suited for encasing the third regenerator $R_2$ inside the crankcase 118.

Generally, the cross-sectional area and length of the third regenerator matrix 216 may be larger or smaller than the cross-sectional area and length of the first regenerator matrix 164 and may in some applications completely replace the first regenerator matrix 164 to significantly reduce the length of the gas expansion unit 112. However, in all cases, the combined thermal regenerator effectiveness of the first regenerator matrix 164 and the third regenerator matrix 216 provides a 100% effective thermal energy exchange with the refrigeration gas. In particular, the thermal regenerators of the device 200 are configured to receive refrigeration gas from the expansion space 142, at a cold temperature of approximately 77° K., and to sufficiently warm the refrigeration gas as it flows through the first regenerator matrix 164 and then through the third regenerator matrix 216, to deliver the refrigeration gas out of the third regenerator matrix 216 at a warm temperature of approximately 270° K. Of course other refrigeration device configuration may operate at other cold and warm temperatures without deviating from the present invention.

Three Regenerators

Figure 5:
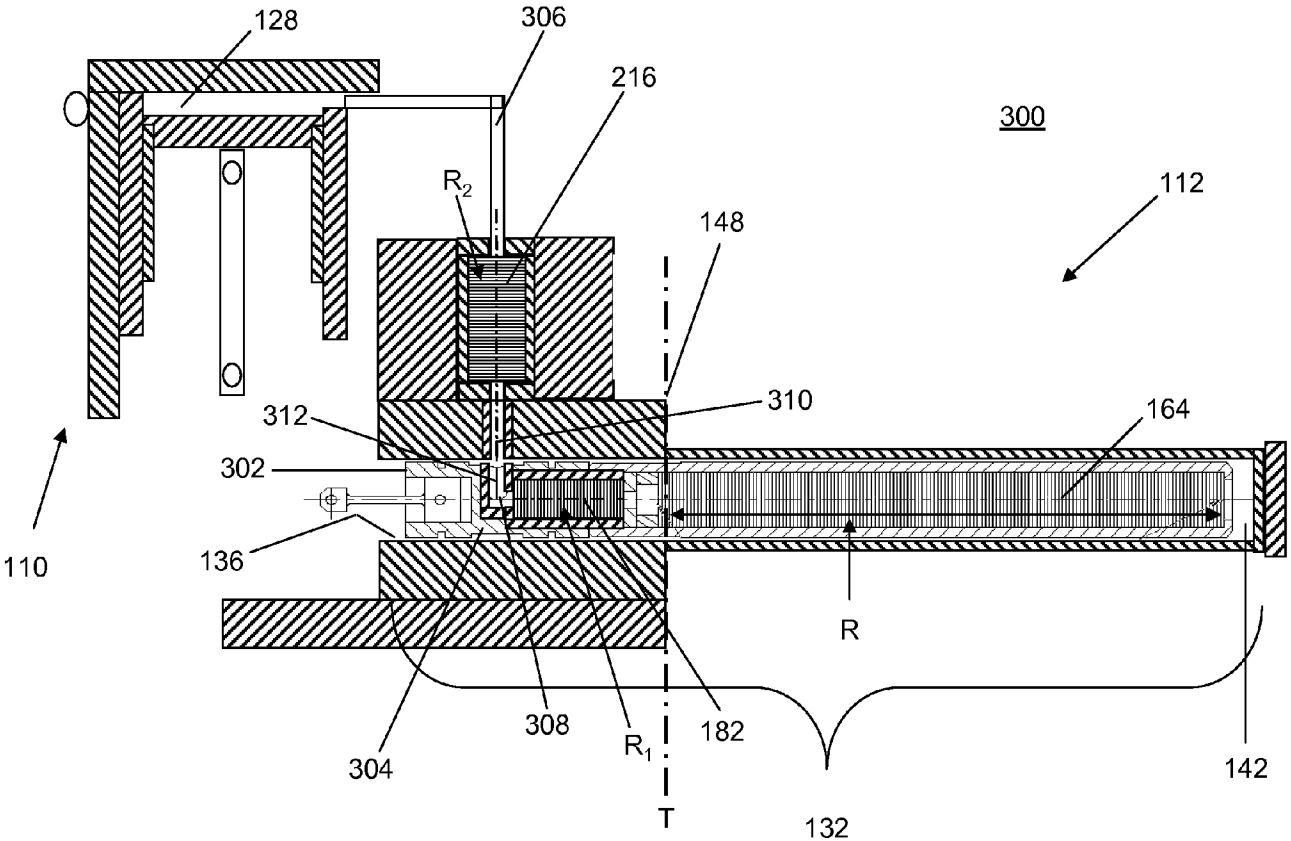
FIG. 5 illustrates a section view taken through portions of an improved refrigeration device utilizing three regenerator modules according to a third embodiment of the present invention.

In a still further embodiment according to the present invention, a refrigeration device 300 is shown in FIG. 5. The refrigeration device 300 is generally configured similarly to the refrigeration devices 100 and 200 described above and the same reference numbers are used to designate like elements. The device 300 includes a gas compression unit 110, with a gas compression volume 128, a gas volume expansion unit 112, with expansion cylinder housing 132 and cylinder 134, and with a gas expansion space 142 at its cold end, and with these elements similarly configured and operating on the same refrigeration cycle as is described above for the device 100.

As shown, the device 300 includes a first regenerator module R disposed at the cold end of a gas displacing piston 302, a second regenerator module $R_1$ disposed inside a fluid control unit 304, and a third regenerator module $R_2$ disposed between the gas compression unit 110 and the gas volume expansion unit 112. A fluid conduit 306 interconnects the third regenerator module $R_2$ and the gas compression volume 128. Each of the regenerator modules of the device 300 are described above and may be configured with the same variations that are also described above in relation with each respective regenerator module.

As further shown in FIG. 5, the fluid control unit 304 includes internal flow passages leading from the second regenerator module $R_1$ to a fluid port 310 and the internal flow passages are lined with a layer of thermally insulating material such as the thermally insulating tubes described above. The flow passages include a short longitudinal passage 308 interconnecting with the second regenerator module $R_1$ and a radial passage 312 extending to the fluid port 310.

Generally, the refrigeration device 300 utilizes three distinct and separated regenerator matrices disposed between the expansion space 142 and the gas compression volume 128 for exchanging thermal energy with the working refrigeration fluid of the device. Each of the regenerator matrices 164, 182 and 216 has a regenerator effectiveness that is less than 100% regenerator effectiveness but the three regenerator matrices used in combination provide a regenerator effectiveness of 100%. Accordingly, the thermal regenerators of the device 300 are configured to receive refrigeration gas from the expansion space 142, at a cold temperature of approximately 77° K., and to sufficiently warm the refrigeration gas as it flows through the first regenerator matrix 164 and then through the second regenerator matrix 182 and then through the third regenerator matrix 216, to deliver the refrigeration gas out of the third regenerator matrix 216 at a warm temperature of approximately 270° K. Of course other refrigeration device configuration may operate at other cold and warm temperatures without deviating from the present invention.

The refrigeration device 300 may be configured with a first regenerator 164 having an even shortened longitudinal length L for further miniaturizing the refrigeration device 300 or its gas expansion unit 112. In particular, with the second regenerator matrix 182 configured with a second regenerator effectiveness equal to the regenerator effectiveness of a length ΔL of the first regenerator matrix 164 and with the third regenerator matrix 216 configured with a third regenerator effectiveness equal to a length ΔL of the first regenerator matrix 164, the first regenerator matrix 164 can be shortened by a length ΔL+ΦL while still providing 100% thermal regenerator effectiveness in the refrigeration device 300.

Figure 7:
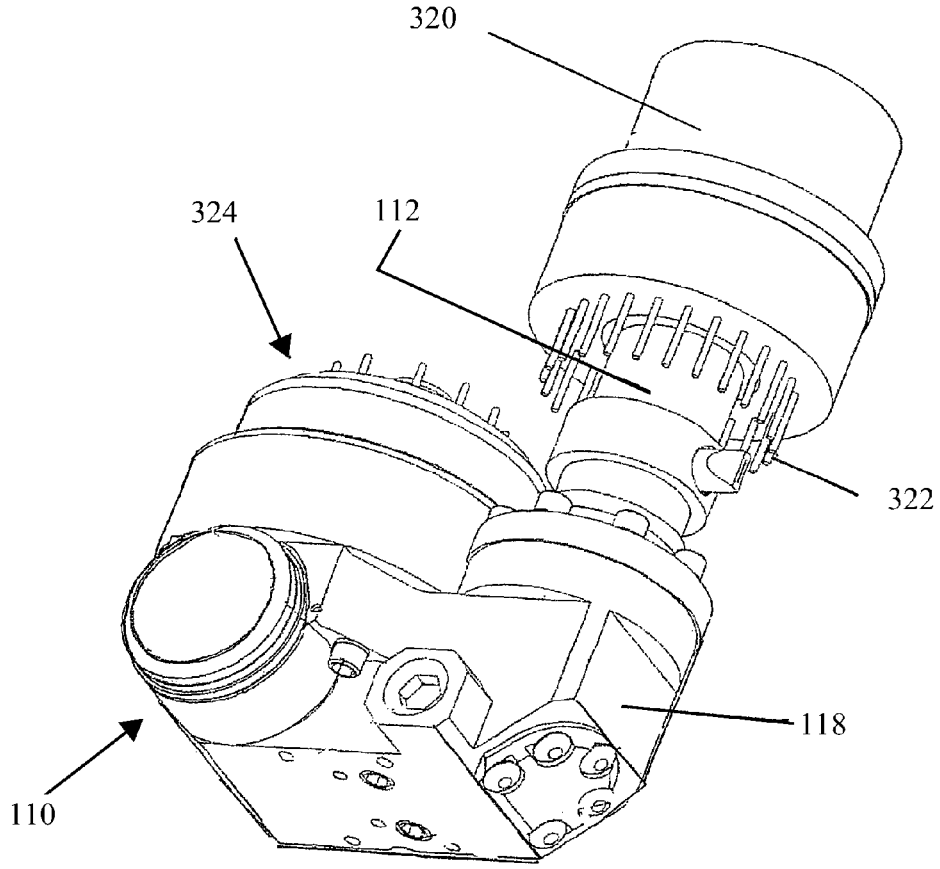
FIG. 7 illustrates an external view of a miniature refrigeration device configured according to the present invention.

Referring now to FIG. 7, an external view of the preferred embodiment of a refrigeration device 100, according to the present invention, is shown in isometric view. In particular, a unitary crankcase 118 integrally supports the gas compression unit 110 and the volume expansion unit 112. In the view shown, the refrigeration device 100 is configured to cool an infrared sensor, not shown. The infrared sensor is attached to the cold end of the volume expansion unit 112 and surrounded by a dewer 320. The dewer 320 provides a vacuum chamber surrounding the infrared sensor to thermally insulate the sensor from surrounding air. A plurality electrical connecting pins 322 interconnect with the infrared sensor and carry sensor signals out of the dewer 320.

The unitary crankcase 118 also integrally supports a rotary DC motor 324. The motor 324 includes a rotating shaft, not shown, and a drive coupling, not shown. The drive coupling converts shaft rotation into linear motion and drives each of the compressor drive link 130 and the volume expander drive link 144 in a desired phase relationship for generating refrigeration cooling. In the embodiment of the device 100 shown in FIG. 7, the fluid conduit 114 is formed integrally with the crankcase 118.

It will also be recognized by those skilled in the art that, while the invention has been described above in terms of preferred embodiments, it is not limited thereto. Various features and aspects of the above described invention may be used individually or jointly. Further, although the invention has been described in the context of its implementation in a particular environment, and for particular applications, e.g. as a Stirling cycle refrigeration device, those skilled in the art will recognize that its usefulness is not limited thereto and that the present invention can be beneficially utilized in any number of environments and implementations including but not limited to thermal regenerator combinations used in other heating and cooling devices. Accordingly, the claims set forth below should be construed in view of the full breadth and spirit of the invention as disclosed herein.

I claim:

1. A refrigeration device comprising:

a crankcase;

a compression cylinder disposed within the crankcase and ending in a cylinder head;

a compression piston movably disposed within the compression cylinder, the compression piston separated from the cylinder head by a compression volume and dimensioned with a gas sealing fit with respect to the compression cylinder to prevent pressurized gas from escaping from the compression volume into the crankcase;

a cold finger tube extending from the crankcase;

an expansion cylinder disposed within the crankcase and extending to the cold finger tube, the expansion cylinder including a first fluid port in fluid communication with the compression volume through a fluid conduit extending from the cylinder head to the first fluid port;

a gas displacing piston comprising a fluid control portion disposed in the expansion cylinder and a regenerator tube located in the cold finger tube, the fluid control portion including annular bearing surfaces configured to provide a gas seal between the fluid control portion and the expansion cylinder;

a first regenerator matrix disposed entirely within the regenerator tube and characterized by a first diameter; and a second regenerator matrix disposed entirely within a thermally insulated cavity of the fluid control portion and characterized by a second diameter smaller than the first diameter;

wherein the second regenerator matrix is physically separated from the first regenerator matrix by a thermal barrier and a first fluid passage extending between the first regenerator matrix and the second regenerator matrix; and wherein the fluid control portion includes a second fluid passage extending between the second regenerator matrix towards the first fluid port.

2. The refrigeration device of claim 1 wherein: said regenerator tube includes a porous end cap attached to a distal end of the regenerator tube for holding the first regenerator matrix within the regenerator tube.

3. The refrigeration device of claim 1 wherein:

the thermal barrier comprises annular insulating disks forming the first fluid passage; and the first fluid passage comprises a single fluid aperture.

4. The refrigeration device of claim 1, wherein a local ambient temperature for the crankcase ranges from about 220° K. to about 320° K.

5. The refrigeration device of claim 1, wherein a cold temperature for a distal end of the cold finger tube is substantially less than the local ambient temperature.

6. The refrigeration device of claim 5, wherein the cold temperature is in a cryogenic range.

* * * * *